US005678587A

United States Patent [19]

Bilotti

[11] Patent Number: 5,678,587

[45] Date of Patent: Oct. 21, 1997

[54] UMBRELLA NET

[75] Inventor: Alfred J. Bilotti, Huntington Beach, Calif.

[73] Assignee: Dayva International Inc., Huntington Beach, Calif.

[21] Appl. No.: 599,626

[22] Filed: Feb. 9, 1996

[51] Int. Cl.[6] ..... A04H 15/28

[52] U.S. Cl. ..... 135/98; 135/16; 135/99; 135/33.41

[58] Field of Search ..... 135/16, 98, 99, 135/33.41, 115, 117, 900, 902

[56] References Cited

U.S. PATENT DOCUMENTS

| | | | |
|---|---|---|---|
| 77,207 | 4/1868 | Palmer . | |
| 114,556 | 5/1871 | Heath . | |
| 196,723 | 10/1877 | Sundquist . | |
| 217,074 | 7/1879 | Davis . | |
| 715,603 | 12/1902 | Quarrie et al. | 135/99 X |
| 814,473 | 3/1906 | Patterson . | |
| 905,660 | 12/1908 | Cowdrey . | |
| 1,056,654 | 3/1913 | Fly . | |
| 1,124,420 | 1/1915 | Gough . | |
| 1,409,609 | 3/1922 | Stockle . | |
| 2,113,118 | 4/1938 | Pyatt . | |
| 2,221,366 | 11/1940 | Bisbing et al. | 135/16 |
| 2,943,634 | 7/1960 | Morgan . | |
| 3,419,024 | 12/1968 | Nickerson, Jr. | 135/98 |
| 3,477,453 | 11/1969 | D'Ulisse et al. . | |
| 3,860,022 | 1/1975 | Arndt et al. . | |
| 5,172,712 | 12/1992 | Robinson . | |
| 5,259,408 | 11/1993 | Guerin . | |
| 5,339,748 | 8/1994 | Bilotti . | |

FOREIGN PATENT DOCUMENTS

| | | | |
|---|---|---|---|
| 1175729 | 10/1984 | Canada | 135/98 |
| 1261981 | 4/1961 | France | 135/99 |

*Primary Examiner*—Carl D. Friedman
*Assistant Examiner*—Winnie Yip
*Attorney, Agent, or Firm*—Raymond Sun

[57] ABSTRACT

An umbrella net for use in covering a patio umbrella, the umbrella net having an upper panel having a peripheral edge and a sleeve provided along the peripheral edge. The sleeve has an exposed section, and a first opening and a second opening positioned about the exposed section. The umbrella net further includes a drawstring held within the sleeve and having a first end extending from the first opening and a second end extending from the second opening. The umbrella net also has a wall panel having a top edge connected to the peripheral edge of the upper panel and a bottom edge, the wall panel being adapted to enclose a space defined under the patio umbrella. The drawstring may be used to adjust the height of the wall panel with respect to the ground.

14 Claims, 2 Drawing Sheets

UMBRELLA NET

BACKGROUND OF THE INVENTION

1. Field of the Invention

The present invention relates to outdoor furniture accessories, and in particular, to an umbrella net that may be adapted for use in covering outdoor garden or patio umbrellas of different sizes.

2. Description of the Related Art

Umbrella nets are used to protect and to enclose the space under an outdoor garden or patio umbrella. Patio tables and chairs are placed under such patio umbrellas so that people can relax in the shade provided by the patio umbrella. A conventional umbrella net is typically placed over the top of an opened patio umbrella, with the side of the umbrella net draped over and hanging from the circumferential edge of the patio umbrella to create a walled or enclosed space under the patio umbrella. These umbrella nets are useful in keeping out insects and dirt, and depending on the material used for the umbrella net, may even be useful in protecting the patio table and chairs from the harsh elements of bad weather.

Many of the known umbrella nets are typically made in different sizes to fit patio umbrellas of different sizes. For example, conventional patio umbrellas are typically provided in diameters ranging from six feet to ten feet. Therefore, a particular model of an umbrella net would have to be marketed and sold in several different sizes to accomodate all the conventional patio umbrella sizes on the market. As a result, production, stocking, distribution, inventory control and sale of an umbrella net with several different sizes can be expensive and troublesome. Also, it is not desirable to use an overly-large umbrella net (for example, with an eight-feet diameter) to cover a smaller patio umbrella (for example, with a six-feet diameter), because the side or wall panel of the larger umbrella net will be too long and the bottom of the wall panel will collect as a pile on the ground. This can be aesthetically unattractive and potentially dangerous since someone can trip and fall over the pile of the wall panel of the umbrella net.

Therefore, there is a continuing need to provide an umbrella net that can accomodate a variety of different sizes of patio umbrellas, is easy to use, and is relatively inexpensive to manufacture.

SUMMARY OF THE INVENTION

The objects of the present invention may be achieved by providing an umbrella net for use in covering a patio umbrella. The umbrella net according to the present invention has an upper panel having a peripheral edge and a sleeve provided along the peripheral edge. The sleeve has an exposed section, and a first opening and a second opening positioned about the exposed section. The umbrella net further includes a drawstring retained within the sleeve and having a first end extending from the first opening and a second end extending from the second opening. The umbrella net also has a wall panel having a top edge connected to the peripheral edge of the upper panel, the wall panel being adapted to enclose a space defined under the patio umbrella. The wall panel further includes a first side edge adapted to overlap a second side edge to define an access entryway when the umbrella net is deployed.

The umbrella net according to the present invention further includes a tongue coupled to the peripheral edge about the exposed section of the sleeve between the first opening and the second opening, the tongue having a loop provided therethrough. The first end of the drawstring is adapted to pass through the loop in a first direction and the second end of the drawstring is adapted to pass through the loop in a second direction opposite the first direction. The drawstring includes a first stopper provided at the first end and a second stopper provided at the second end.

In the umbrella net according to the present invention, a bottom edge of the wall panel is adapted to be positioned adjacent the ground. One or more bags containing weights may be attached in spaced-apart manner along the bottom edge of the wall panel to hold down the bottom edge. The first end and the second end of the drawstring may be simultaneously pulled to raise the wall panel with respect to the ground. Conversely, the drawstring may be loosened to lower the wall panel with respect to the ground.

The present invention also provides a method for covering a patio umbrella supported on a ground. The first step of the method provides an umbrella net having an upper panel having a peripheral edge and a sleeve provided along the peripheral edge, the sleeve having an exposed section, and a first opening and a second opening positioned about the exposed section. This umbrella net further includes a drawstring retained within the sleeve and having a first end extending from the first opening and a second end extending from the second opening. This umbrella net also has a wall panel having a top edge connected to the peripheral edge of the upper panel. This umbrella net additionally includes a tongue coupled to the peripheral edge about the exposed section of the sleeve between the first opening and the second opening, the tongue having a loop provided therethrough. In the second step of the method, the first end of the drawstring is passed through the loop in a first direction. The third step of the method passes the second end of the drawstring through the loop in a second direction opposite the first direction. In the fourth step, the umbrella net is draped over the patio umbrella such that the upper panel covers the apex of the patio umbrella and the wall panel hangs from the patio umbrella to enclose a space underneath the umbrella. In the fifth step, the height of the wall is adjusted, for example, by simultaneously pulling the first end and the second end of the drawstring to adjust the height of the wall panel with respect to the ground. In the sixth step, the first end and the second end of the drawstring are tied to secure the wall panel of the umbrella net at a desired height.

The umbrella net according to the present invention can be used with patio umbrellas of different sizes. For instance, an umbrella net can have a diameter adapted for use with the largest diameter patio umbrella on the market, but can also be used with smaller diameter patio umbrellas since the drawstring action allows the wall panel of the umbrella net to be pulled or raised off the ground to conform to smaller diameter patio umbrellas. The umbrella net of the present invention is also effective in protecting outdoor furniture items as such patio chairs and tables, since the drawstring provides the umbrella net with a snug and tight fit with the patio umbrella to protect the enclosed space. The umbrella net is also easy to use, and is durable. Production, stocking, distribution and marketing costs are reduced since one size can fit a number of different sizes of patio umbrellas.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
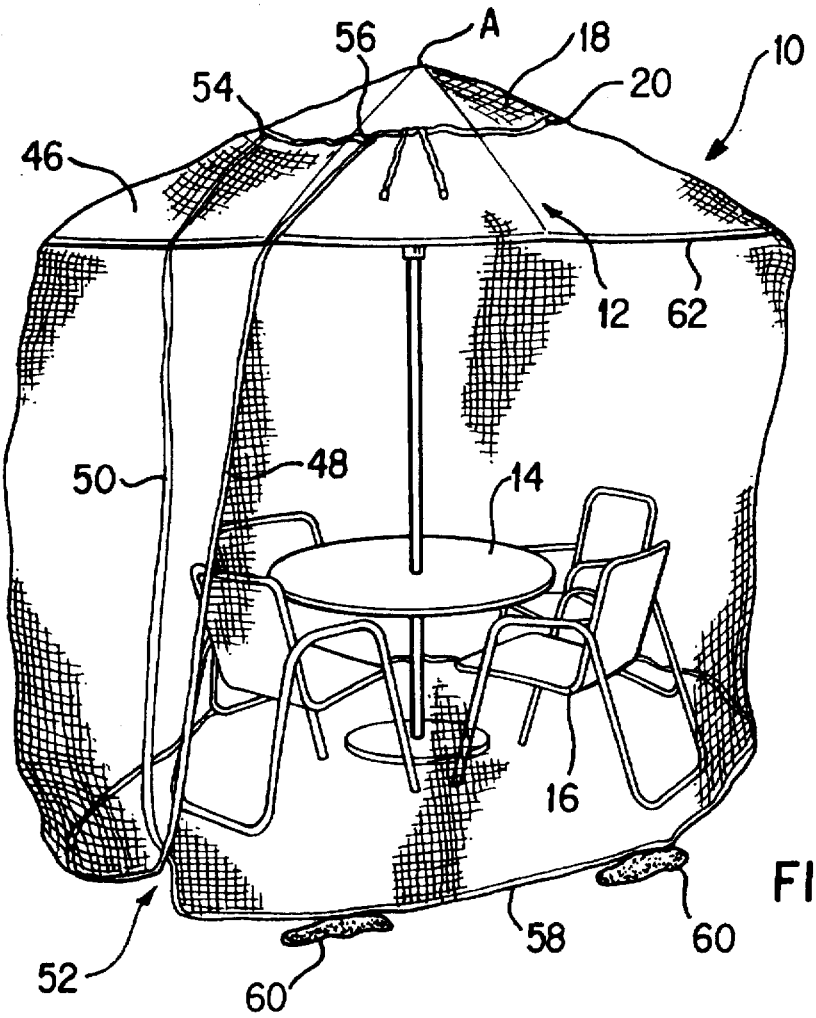
FIG. 1 is a perspective view of an umbrella net according to an exemplary embodiment of the present invention shown in use with a conventional patio umbrella.
Figure 2:
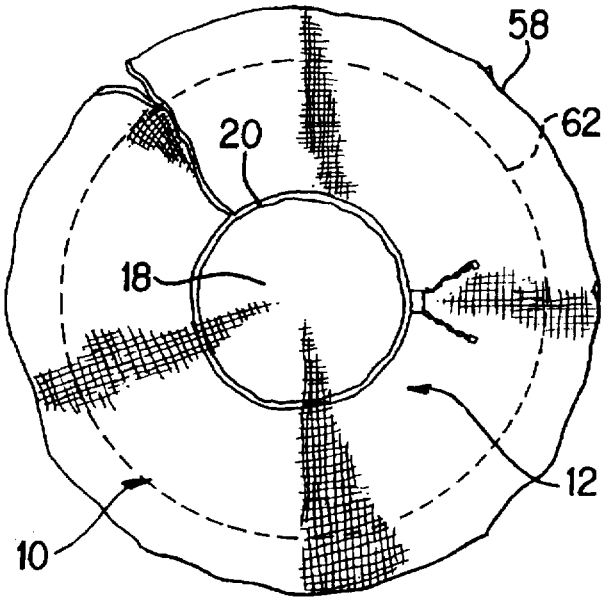
FIG. 2 is a top plan view of the umbrella net of FIG. 1.
Figure 3:
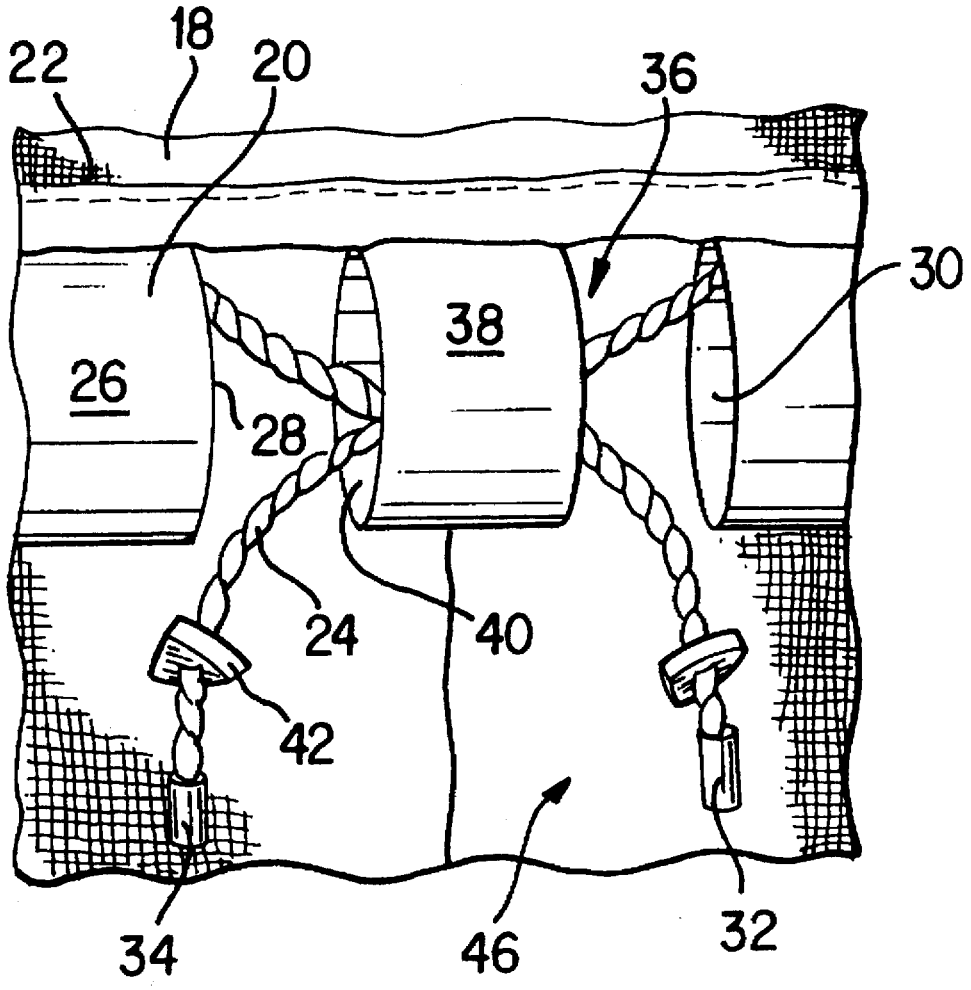
FIG. 3 is a side plan view of the drawstring connection of the umbrella net of FIG. 2.

Referring to FIG. 1, an umbrella net 10 according to an exemplary embodiment of the present invention is shown draped over a patio umbrella 12 to form an enclosed space. A patio table 14 and four patio chairs 16 are placed under the patio umbrella 12 within the enclosed space. Referring now to FIGS. 1–3, the umbrella net 10 has an upper panel 18 having a substantially circular shape similar to the shape of a conventional patio umbrella. An annular sleeve 20 is provided adjacent a peripheral edge 22 of the upper panel 18.

The sleeve 20 retains a drawstring 24 which is used to adjust the umbrella net 10 to the size of the patio umbrella 10 in the manner described hereinbelow. The sleeve 20 may be formed by any conventional method. For example, in a preferred embodiment shown in FIG. 3, a piece of cloth 26 is folded over and stitched to the peripheral edge 22 to form the sleeve 20. Alternatively, the peripheral edge 22 may be folded over and then stitched to form the sleeve 20. Other ways of forming the sleeve 20 can be used without departing from the spirit and scope of the present invention.

Referring more particularly to FIG. 3, the sleeve 20 does not extend throughout the entire circumferential peripheral edge 22 of the upper panel 18. Specifically, the sleeve 20 has opposite open ends 28 and 30 to allow the opposite ends 32 and 34, respectively, of the drawstring 24 to extend therefrom. A space or exposed section 36 is defined between the open ends 28 and 30 of the sleeve 20. A tongue 38 is connected to the peripheral edge 22 at the space 36 with a loop 40 provided in the tongue 38. A first end 32 of the drawstring 24 extending from the first opening 28 of the sleeve 20 is passed through the loop 40. A second end 34 of the drawstring 24 extending from the second opening 30 of the sleeve 20 is also passed through the loop 40, but in a direction opposite to that of the first end 32. Thus, the ends 32 and 34 of the drawstring 24 are "crossed" at the tongue 38. Any conventional stopper 42 may be provided at the ends 32 and 34 to prevent the ends 32 and 34 from slipping backwards across the loop 40.

A wall panel 46 has a top edge stitched or otherwise attached to the peripheral edge 22. The wall panel 46 has a first side edge 48 and a second side edge 50, and extends around the peripheral edge 22 such that the first side edge 48 overlaps the second side edge 50 (see FIG. 1) to form an access entryway 52 and to ensure that the enclosed space is securely enclosed or covered. Specifically, the top edge of the wall panel 46 is attached to the peripheral edge 22 beginning at a first location 54 adjacent the second side edge 50, and extends annularly around the peripheral edge 22, overlapping the first location 54, to a second location 56 adjacent the first side edge 48. The overlap of the side edges 48, 50 of the wall panel 46 ensure that the entryway 52 is always covered. For ingress or egress, an individual merely lifts the first side edge 48 to create an opening at the access entryway 52, and enters or exits through this opening. The bottom edge 58 of the wall panel 46 may be lined with a fabric or other material to protect it and to render it more durable to the wear and tear experienced by its frequent contact with the ground. In addition, one or more bags 60 containing weights may be sewn or otherwise attached in spaced-apart manner along the bottom edge 58 to keep the bottom edge 58 adjacent or on the ground even in the presence of windy conditions.

The upper panel 18 may be any kind of canvas, fabric or sewable material, and is preferably made of a tough flexible material such as vinyl, cotton, canvas, acrylic or plastic. The top of the upper panel 18 may be decorated with a pattern and colors, and may also be coated with a protective covering such as water proofing or scotch-guarding. The underside of the upper panel 18 may be provided with a soft cloth-like material such as foam or felt to protect the top surface of the patio umbrella 12.

The wall panel 46 is preferably made from a nylon or fabric umbrella netting which is coated or otherwise provided with ultraviolet-insulating material or substances to resist the rays of the sun. The netting preferably has a plurality of small holes or openings to prevent insects and larger dirt particles from entering the enclosed space, yet allows air to circulate therethrough. The netting material also preferably allows people to see through it.

The drawstring 24 may be made from any durable material such as cotton, nylon, vinyl or plastic. The tongue 38 is preferably made from a flexible and sewable material, and is preferably made of the same material as the upper panel 18, or fabric, or the netting used for the wall panel 46.

The use of the umbrella net 10 according to the present invention will now be described. The patio umbrella 12 is first opened. In the first step, which is the draping step, the umbrella net 10 is draped over the top of the patio umbrella 12 so that the upper panel 18 covers the apex A of the patio umbrella 12 and the surrounding central portion of the patio umbrella 12. During this draping step, the wall panel 46 is allowed to hang or is suspended from the outer circumferential edges 62 of the patio umbrella 12 so that the bottom edge 58 of the wall panel 46 contacts the ground, and depending on the size of the patio umbrella 12, collects as a pile on the ground. Thus, the umbrella met 10 now encloses a defined space under the patio umbrella 12. During this draping step, the drawstring 24 is held loosely within the sleeve 20 and with the peripheral edge 22 extended to its maximum circumference.

The umbrella net 10 is provided in a size that can sufficiently cover the largest diameter patio umbrella 12 on the market (such as a ten-foot diameter patio umbrella), since the drawstring mechanism described above can be used in the manner described below to adapt the larger diameter umbrella net 10 to fit and properly cover smaller diameter patio umbrellas 12.

After the umbrella net 10 has been draped over the patio umbrella 12, the second step is to adjust the height of the wall panel 46. In this adjusting step, both ends 32 and 34 of the drawstring 24 are simultaneously pulled to cause the peripheral edge 22 to wrap securely around the central region of the patio umbrella 12 adjacent the apex A. Further pulling of the ends 32 and 34 will cause the diameter of the upper panel 18 and the circumference of the peripheral edge 22 to decrease, thereby pulling the peripheral edge 22 and the connected wall panel 46 upwardly towards the apex A of the patio umbrella 12.

Therefore, tightening or loosening the drawstring 24 allows the height of the wall panel 46 to be adjusted so that its bottom edge 58 can be adjusted to be barely off the ground or to barely contact the ground, and to avoid having a pile of the wall panel 46 collect on the ground. For example, if the patio umbrella 12 has a ten-foot diameter, the drawstring 24 will not need to be tightened very much since the wall panel 46 should be at about ground level after the draping step. The user can then adjust the height of the wall panel 46 depending on whether he or she prefers the bottom edge 58 to be barely off the ground or to barely contact the ground. If, however, a six-foot diameter patio umbrella 12 is to be covered by the umbrella net 10, then the drawstring 24 will need to be tightened to a greater degree to pull the excess bottom portions of the wall panel 46 off the ground.

The third step, the securing step, takes place after the user has adjusted the height of the wall panel 46 with respect to the patio umbrella 12. In the securing step, the ends 32 and 34 of the drawstring 24 are tied to obtain a tight wrap. In this tied position, the wall panel 46 will be secured at the desired height during use. To adjust the height of the wall panel 46 or to remove the umbrella net 10, the user merely unties the ends 32 and 34 of the drawstring 24 and loosens the drawstring 24.

During the deployment of the umbrella net 10, the tongue 38 and the "crossed" ends 32 and 34 serve an important purpose in protecting the sleeve 20 at the openings 28 and 30. If the tongue 38 is not provided, repeated pulling of the ends 32 and 34 will cause the seams of the sleeve 20 at the openings 28 and 30 to experience a significant amount of friction, and could result in the tearing of the seams at those locations. "Crossing" the ends 32 and 34 through the loop 40 of the tongue 38 relieves much of the pressure on the seams at the openings 28 and 30 and provides for a more durable umbrella net 10.

The umbrella net 10 of the present invention provides an umbrella net 10 that can be used with patio umbrellas of different sizes. For instance, an umbrella net 10 can have a diameter adapted for use with the largest diameter patio umbrella on the market, and can be adapted to be used with smaller diameter patio umbrellas since the drawstring 24 action allows the wall panel 46 of the umbrella net 10 to be pulled off the ground to conform to smaller diameter patio umbrellas. The umbrella net 10 of the present invention is also effective in protecting outdoor furniture items as such patio chairs and tables, since the drawstring 24 provides the umbrella net 10 with a snug and tight fit with the patio umbrella 12 to protect the enclosed space. The umbrella net 10 is also easy to use, and is durable. Production, stocking, distribution and marketing costs are reduced since one size can fit a number of different sizes of patio umbrellas.

Furthermore, although the umbrella net 10 has been described in connection with a substantially circular shape, it is within the scope of the present invention to provide the umbrella net 10 in other shapes for use with patio umbrellas of different shapes.

While the description above refers to particular embodiments of the present invention, it will be understood that many modifications may be made without departing from the spirit thereof.

What is claimed is:

1. An umbrella net for use in covering a patio umbrella that is supported on a ground, the patio umbrella having an apex, the umbrella net comprising:

an upper panel having a peripheral edge and adapted to cover the top of the apex;

a sleeve provided along the peripheral edge, the sleeve having an exposed section, the sleeve further comprising a first opening and a second opening positioned about the exposed section;

a drawstring retained within the sleeve and having a first end extending from the first opening and a second end extending from the second opening; and a wall panel having a top edge connected to the peripheral edge of the upper panel and a bottom edge, the wall panel adapted to enclose a space defined under the patio umbrella, and wherein, after the umbrella net has been positioned over the patio umbrella, the first and second ends of the drawstring are simultaneously pulled to raise the wall panel with respect to the ground.

2. The umbrella net of claim 1, wherein the wall panel further comprises a first side edge and a second side edge, the first side edge adapted to overlap the second side edge to define an access entryway when the umbrella net is deployed to cover a patio umbrella.

3. The umbrella net of claim 2, further comprising a tongue coupled to the peripheral edge about the exposed section of the sleeve between the first opening and the second opening, the tongue having a loop provided therethrough, wherein the first end of the drawstring passes through the loop in a first direction and the second end of the drawstring passes through the loop in a second direction opposite the first direction.

4. The umbrella net of claim 1, further comprising a tongue coupled to the peripheral edge about the exposed section of the sleeve between the first opening and the second opening, the tongue having a loop provided therethrough, wherein the first end of the drawstring passes through the loop in a first direction and the second end of the drawstring passes through the loop in a second direction opposite the first direction.

5. The umbrella net of claim 4, wherein the drawstring comprises a first stopper provided at the first end and a second stopper provided at the second end.

6. The umbrella net of claim 4, wherein the bottom edge of the wall panel is adapted to be positioned adjacent the ground.

7. The umbrella net of claim 6, further comprising at least one bag containing weights attached in spaced-apart manner along the bottom edge of the wall panel.

8. The umbrella net of claim 4, wherein the first end and the second end of the drawstring are tied to secure the upper panel to the top of the patio umbrella.

9. The umbrella net of claim 1, wherein the drawstring is loosened to lower the wall panel with respect to the ground.

10. A method for covering a patio umbrella supported on a ground, the patio umbrella having an apex, the method comprising the steps of:

(a) providing an umbrella net comprising:

(i) an upper panel having a peripheral edge and adapted to cover the top of the apex;

(ii) a sleeve provided along the peripheral edge, the sleeve having an exposed section, and the sleeve further comprising a first opening and a second opening positioned about the exposed section;

(iii) a drawstring retained within the sleeve and having a first end extending from the first opening and a second end extending from the second opening; and (iv) a wall panel having a top edge connected to the peripheral edge of the upper panel and a bottom edge (b) draping the umbrella net over the patio umbrella such that the upper panel covers the apex of the patio umbrella and the wall panel hangs from the patio umbrella to enclose a space; and (c) adjusting the height of the wall panel with respect to the ground by simultaneously pulling the first end and the second end of the drawstring.

11. The method of claim 10, further comprising the step of:

(d) tying the first end and the second end of the drawstring to secure the wall panel of the umbrella net at a desired height.

12. The method of claim 11, further comprising the step of:

(e) providing at least one weight at the bottom edge of the wall panel.

13. The method of claim 10, wherein step (c) further comprises the step of loosening the first and second ends of the drawstring to lower the wall panel with respect to the ground.

14. The method of claim 10, wherein the umbrella net further comprises a tongue coupled to the peripheral edge about the exposed section of the sleeve between the first opening and the second opening, the tongue having a loop provided therethrough, and wherein step (a) further comprises the steps of:

passing the first end of the drawstring through the loop in a first direction; and passing the second end of the drawstring through the loop in a second direction opposite the first direction.

* * * * *